US005534126A

United States Patent [19]

Stadler et al.

[11] Patent Number: 5,534,126

[45] Date of Patent: Jul. 9, 1996

[54] APPARATUS AND METHOD FOR SELECTIVE COATING OF METAL PARTS

[75] Inventors: David M. Stadler, Lathrup Village; Jeffrey R. Pernick, Commerce, both of Mich.

[73] Assignee: International Hardcoat, Inc., Detroit, Mich.

[21] Appl. No.: 386,012

[22] Filed: Feb. 9, 1995

[51] Int. Cl.[6] ..... C25D 21/18; C25D 5/02; C25D 17/06; C25B 9/00

[52] U.S. Cl. ..... 205/101; 205/118; 205/136; 205/137; 205/145; 205/151; 205/224; 205/324; 204/224 R; 204/237; 204/275; 204/297 R; 204/297 W

[58] Field of Search ..... 205/118, 101, 205/122, 128, 136, 151, 224, 210, 220, 324, 137, 145; 204/224 R, 237, 275, 297 R, 297 W

[56] References Cited

U.S. PATENT DOCUMENTS 4,750,981 6/1988 Dalland et al. ..... 204/224 R
5,368,715 11/1994 Hurley et al. ..... 205/101

*Primary Examiner*—John Niebling
*Assistant Examiner*—Edna Wong
*Attorney, Agent, or Firm*—Dykema Gossett

[57] ABSTRACT

An apparatus and method for simultaneously anodizing the heads of several aluminum pistons includes a plating tank having an array of apertures extending through one of its side walls, one aperture for each piston; and means for securing the head of each piston in its respective aperture. A seal disposed in each aperture ensures that the aperture is sealed upon the securing of the piston therein, with only the piston's head being placed in fluid communication with the interior of the plating tank. An acid electrolyte is directed into the plating tank through electrically-conductive sparging nozzles positioned therein opposite the heads of the pistons, thereby forming an electrolytic cell with the pistons as anodes and the sparging nozzles as cathodes. A power supply simultaneously applies a current to the cell, i.e., across the electrolyte via the pistons and sparger nozzles, to effect electrolytic coating of each piston's head. After the desired coating is achieved, the current is removed and the electrolyte drained from the tank. Rinse water is then directed into the tank through the same sparging nozzles to rinse any remaining electrolyte from the pistons. After the rinse water is drained, hot water is directed into the tank through the sparging nozzles to seal the coating. After a final draining of the tank, the coated pistons are removed from the apertures.

19 Claims, 5 Drawing Sheets

APPARATUS AND METHOD FOR SELECTIVE COATING OF METAL PARTS

BACKGROUND OF THE INVENTION

The present invention generally relates to apparatus and methods for the selective coating of metal parts using an electrolytic deposition process, as might be advantageous for hardcoat anodizing the heads of aluminum pistons to be used in an internal combustion engine. More specifically, the invention relates to apparatus and methods for continuously processing such metal parts with minimal handling to obtain coatings of superior quality and consistency while simultaneously lessening their relative cost.

Known processes for the selective coating of metal parts, such as the heads of aluminum pistons, generally include a series of timed dips in one or more baths of appropriate cleaning, etching, plating and/or rinsing solutions to generate the desired single or multilayered coating thereon. Complex materials-handling equipment is required to achieve these sequential dips, including equipment for transporting racks containing multiple workpieces between each bath, and for lowering the racks into each bath for a prescribed time period. A large physical plant is thus required to house both the materials-handling equipment and the requisite processing baths, implicating substantial capital investment.

While some processes for producing multilayered coatings may reduce the number of physical "dips" required, as through use of a single bath containing a "mixed" plating solution combined with alternating anodic and cathodic plating steps, as taught in U.S. Pat. No. 3,556,958 to Hutchings et al, there nonetheless remains a substantial need for the handling of individual and/or racked workpieces during such processes. Such handling, in turn, can adversely impact the overall quality and consistency of the resulting coating while further increasing its relative cost, both in terms of increased coating times and equipment/capital requirements.

Indeed, in the event that only a portion of the workpiece is to be coated, as where a coating is sought only on the head of a piston, a further substantial expense is encountered when masking-off those areas which are to remain coating-free, with yet further complications in handling the masked workpieces.

Another problem encountered with known methods for coating metal parts lies in the fact that many of the solutions used therein must be maintained at temperatures other than at ambient temperature. For example, it is well known that the optimal temperature of the sulfuric acid electrolyte used in the hardcoat anodizing of 6000-series aluminum alloys is 32°±2° F. (0°±1° C.), with the parts perhaps being subsequently dipped into hot water maintained at a temperature of at least 200° F. (95° C.) for perhaps 15 minutes in order to hydrate/seal the resultant aluminum-oxide coating. Similarly, the nominal temperature of a chromic acid electrolyte bath is preferably 100°±9° F. (37°±5° C.).

Given the open processing tanks typical of such known coating methods, a great deal of energy must be expended in heating or cooling its various solutions to the proper temperature. The latent heat of the sizable racks and other materials-handling equipment used in connection with those methods must also be factored into the energy equation, as must the larger processing tanks and greater quantities of solutions required to accommodate such parts-handling equipment.

Moreover, such known coating methods inherently pose certain safety problems to workers and the environment. In particular, the use by such methods of open processing baths exposes workers to fumes generated either by the solutions themselves or as a byproduct of electrolysis, with the intensity of the fumes almost certainly increased through requisite agitation of each bath. And, since the processing baths must remain open for substantial periods to accommodate the parts-handling equipment, there is little opportunity to recover such fumes and, hence, greater harm to the environment.

Accordingly, what is needed is a semi-automatic method for the selective coating of metal parts, such as pistons, which avoids the aforementioned problems to provide a single or multilayered coating of superior quality and consistency, preferably at a lower cost.

SUMMARY OF THE INVENTION

It is an object of the invention to provide an apparatus and method for the selective coating of metal parts featuring reduced handling of such metal parts.

It is another object of the invention to provide an apparatus and method for the selective coating of metal parts which reduces or otherwise eliminates masking requirements.

It is another object of the invention to provide an apparatus and method for the selective coating of metal parts which requires reduced floor space.

It is another object of the invention to provide an apparatus and method for the selective coating of metal parts which requires smaller amounts of the various processing solutions.

It is another object of the invention to provide an apparatus and method for the selective coating of metal parts which requires smaller amounts of energy.

A further object of the invention is to provide an apparatus and method for the selective coating of metal parts featuring reduced worker exposure to the various solutions used therein and, particularly, to the byproducts of electrolysis.

Yet another object of the invention is to provide an apparatus and method for the selective coating of metal parts which maintains its various processing solutions, and performs each of its processing steps, in sealed containers, thereby promoting increased environmental safety while reducing energy requirements and evaporative loss.

Under the invention, an apparatus for selectively coating a first surface portion of an electrically-conductive workpiece includes a plating tank, wherein the plating tank includes a wall having an aperture formed therein adapted to receive the workpiece; an electrode extending into the plating tank; and a drain. The apparatus further includes a means for temporarily securing the workpiece in the aperture so as to place the first surface portion of the workpiece in fluid communication with the interior of the plating tank; and a seal disposed in the aperture for sealing the aperture about the workpiece when the workpiece is secured therein, such that only the first surface portion of the workpiece is placed in fluid communication with the interior of the plating tank.

More specifically, in a preferred embodiment of the apparatus, the means for temporarily securing the workpiece in the aperture includes a fixture adapted to receive the workpiece, and an actuator mounted on the plating tank for translating the fixture relative to the aperture. The actuator thereby operates to controllably insert and secure the workpiece within the aperture. For example, where the workpiece is a piston whose head alone is to be coated in accordance with the invention, the fixture preferably includes a post which functions much like a wrist pin to retain the piston thereon. The fixture would also preferably include a cradle for supporting the piston so as to prevent its rotation about the post. And, in a preferred embodiment, the actuator also operates to rotate the fixture relative to the tank to facilitate placement of the workpiece into the fixture.

In accordance with the present invention, the apparatus further includes a means for directing an electrolyte into the plating tank such that the electrolyte bridges the workpiece and the electrode; and a power supply connected to the workpiece and the electrode, respectively, for applying a current across the electrolyte in the plating tank when the electrolyte bridges the workpiece and the electrode, whereby an electrolytic coating is generated on the first surface portion of the workpiece. The apparatus also includes a means for directing a rinsing fluid into the plating tank to rinse the first surface portion of the workpiece, whereby any remaining electrolyte is removed from the workpiece.

In accordance with yet another feature of the present invention, the means for directing the electrolyte into the plating tank preferably includes a sparger nozzle positioned within the tank centralized opposite the first surface portion of the workpiece when the workpiece is secured in the aperture. The centralized sparger nozzle and fluid manifold thereof is further preferably formed of an electrically-conductive material so that it may be used as an electrode (cathode) of the electrolytic cell formed when the workpiece (the cell's anode) is secured in the plating tank's aperture and the electrolyte is directed into the plating tank.

The means for directing the electrolyte into the plating tank preferably further includes a storage tank for storing a supply of the electrolyte, a supply conduit extending from the storage tank to the plating tank, a pump operative to pump electrolyte stored in the storage tank through the supply conduit into the plating tank, and a first return conduit extending from the drain of the plating tank to the storage tank. The electrolyte may thus be circulated between the plating tank and the storage tank, thereby reducing the quantity of electrolyte required under the present invention.

To the extent that other processing solutions are to be directed into the plating tank, either before or after the electrolyte, in order to obtain the desired coating, those other solutions are likewise maintained in discrete storage tanks, to be circulated through the plating tank through additional conduits (while, preferably, sharing the same sparging nozzles). In this regard, it is noted that the rinsing fluid, typically tap water directed into the plating tank through the sparging nozzles after a processing solution is drained therefrom, will preferably not be recirculated. Rather, such rinsing fluid is preferably drained from the plating tank and delivered by a separate conduit directly to suitable waste water treatment equipment.

And, in accordance with yet another feature of the invention, the storage tanks and conduits are insulated to maintain the electrolyte and any other non-room-temperature solutions at their optimal temperatures, e.g., 32°±2° F. (0°±1° C.) for the sulfuric acid electrolyte used for hardcoat anodizing aluminum alloys. Since the electrolyte and other heated/cooled solutions circulated through the plating tank are themselves maintained in small, insulated storage tanks rather than the open processing tanks so typical of prior art methods, the energy requirements of the present apparatus and method are markedly reduced. As an added benefit of such circulation, the temperatures of the circulated solutions—particularly that of the electrolyte as it is sparged by the nozzles onto the workpiece—may be tightly regulated, with an attendant increase in coating quality and consistency.

Finally, under the present invention, the plating tank is preferably fully closed or sealed; and a second return conduit, connected to the plating tank at a point therein above the normal operating level of the electrolyte, extends from the plating tank to the storage tank. In addition to performing the function of an overflow return, the second return conduit serves to vent the byproducts of electrolysis, particularly the hydrogen gas generated thereby, back to the storage tank, either for recovery or for ultimate disposal. In this manner, the plating tank remains sealed to protect workers from the fumes generated by the coating process.

From the foregoing, it will be appreciated that, in accordance with the present invention, an electrically-conductive workpiece is secured in an aperture extending through a wall of a plating tank and otherwise adapted to sealingly engage the workpiece such that only a desired surface portion of the workpiece is placed in fluid communication with the interior of the plating tank. With the plating tank thus sealed, a pre-electrolyte treating fluid may be first directed into and then drained from the plating tank. Examples of such pre-electrolyte treating fluids include, without limitation, known cleaning solutions, caustic etches, deoxidizing solutions, activating solutions and water. Indeed, a purge or rinsing fluid such as tap water is preferably directed into and subsequently drained from the plating tank immediately prior to the introduction of an electrolyte thereinto.

The electrolyte is then directed into the plating tank, preferably through a sparging nozzle such that the electrolyte is sparged onto the exposed surface portion of the workpiece. With the electrolyte bridging both the workpiece and an electrode located within the plating tank (which electrode preferably comprises the very nozzle and manifold used to sparge the electrolyte onto the workpiece surface), a current is applied to the electrolyte to generate an electrolytic coating on the exposed surface of the anodic workpiece.

As was noted above when describing a preferred apparatus in accordance with the present invention, the electrolyte is preferably circulated between the plating tank and an insulated storage tank so as to sparge only "fresh" electrolyte, i.e, bubble-free electrolyte of desired temperature and composition, onto the surface of the workpiece during application of the current thereto. In this manner, a coating of superior quality and consistency is obtained. In a preferred method, the plating tank is vented during electrolysis to a remote location for recovery or disposal of the heat and gas byproducts generated thereby.

Once the desired coating has been generated, the current is removed, the flow of electrolyte into the plating tank is stopped, and the plating tank is drained of electrolyte. A rinsing fluid such as tap water or other neutralizing solution is thereafter directed into the plating tank, preferably through the same sparging nozzles used for sparging pre-electrolyte treating fluids and electrolyte onto the exposed surface of the workpiece. In this manner, any remaining electrolyte is removed from the workpiece.

After the rinsing fluid is completely drained from the plating tank, any desired post-electrolyte treating fluid may be similarly directed into and subsequently drained from the plating tank, possibly with a further rinse of the plating tank in the manner described above. Examples of suitable post-electrolyte treating fluids include, without limitation, a sealant such as hot water, steam or sodium dichromate; a solution containing a dye; and a solution containing a dry lubricant such as polytetrafluoroethylene (PTFE or "Teflon®").

In a preferred method of practicing the invention, where the coated surface is below room temperature after the final rinse, heated air is circulated through the tank to raise the temperature of the coated surface and, hence, prevent later condensation of ambient moisture on the workpiece upon removal of the workpiece from the aperture. The workpiece is thereafter removed from the aperture to complete the processing thereof.

BRIEF DESCRIPTION OF THE DRAWINGS

Referring to the drawings, wherein like reference numerals are used to designate like elements in each of the several figures.

DETAILED DESCRIPTION OF THE PREFERRED EMBODIMENT

Figure 1:
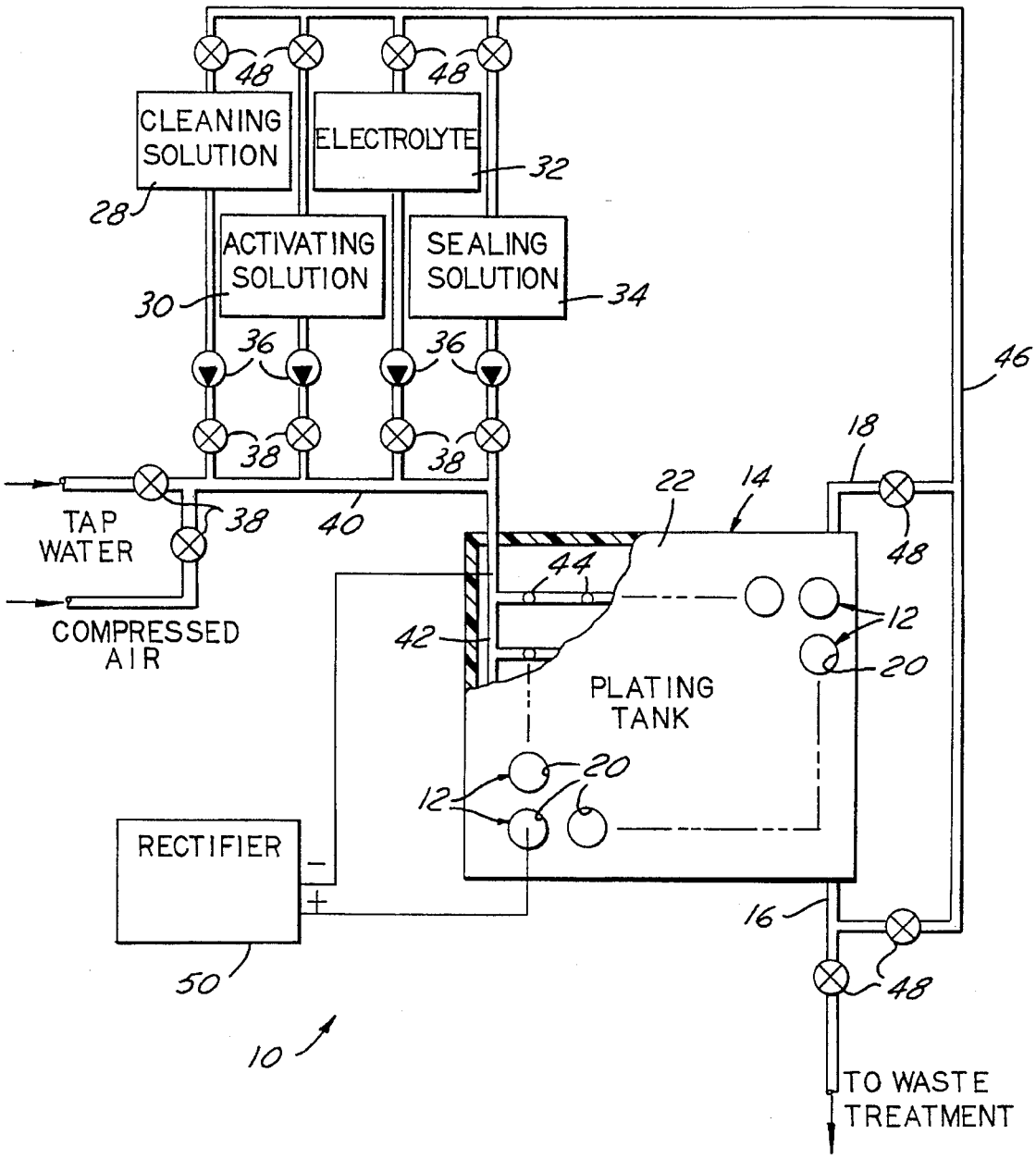
FIG. 1 is a schematic illustration of a preferred apparatus for cleaning, activating, hardcoat anodizing and rinsing the heads of several aluminum pistons simultaneously in accordance with the present invention (for clarity, shown without the means for securing each piston in its respective aperture in the plating tank)
Figure 2:
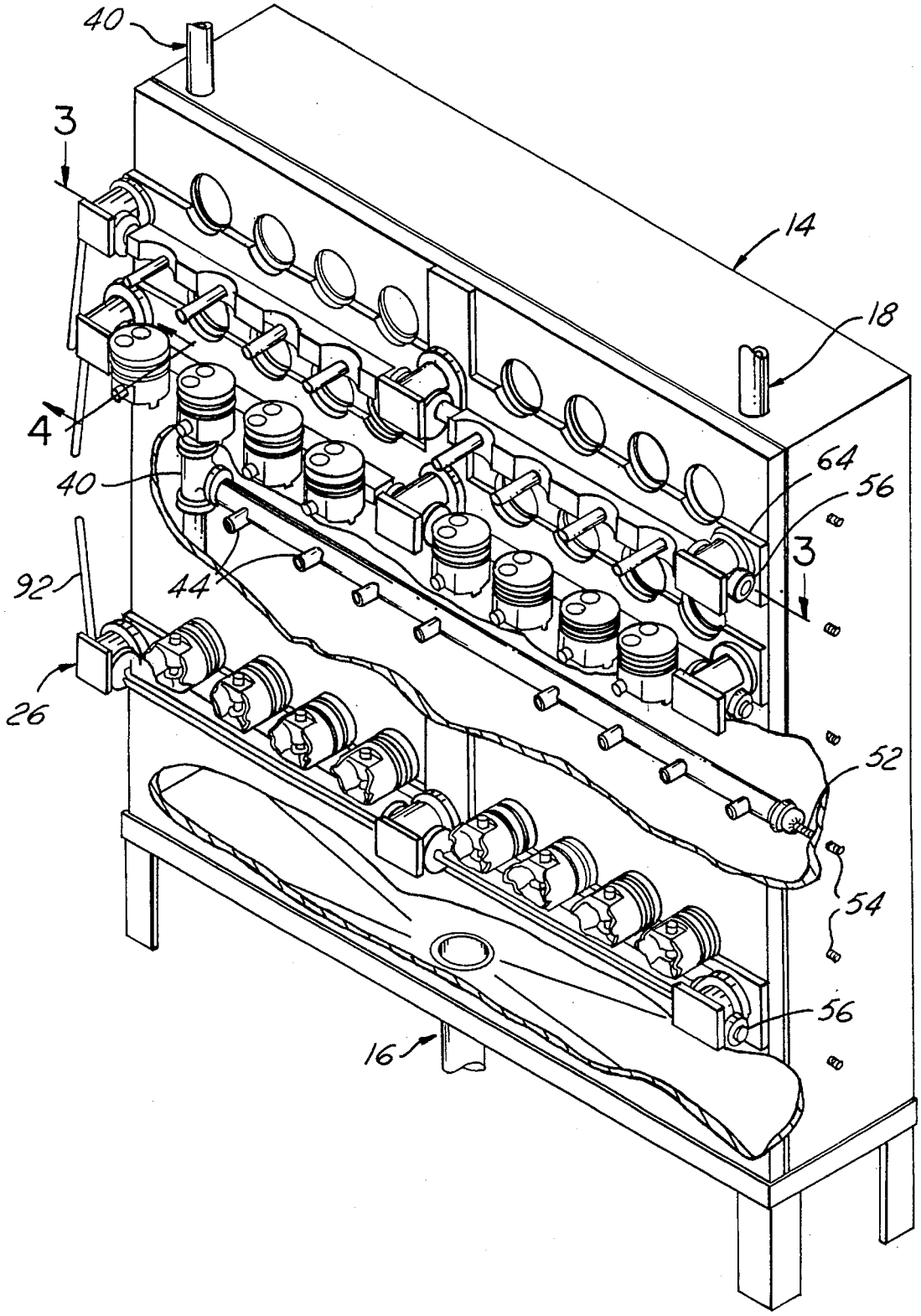
FIG. 2 is a view in perspective, partially broken away, of a plating tank constructed in accordance with the invention for use in simultaneously hardcoat anodizing the heads of several aluminum pistons, including a cammed actuator/fixture thereon for removably inserting and securing the pistons in the corresponding apertures formed in the tank's front wall, and a supply conduit extending within the tank having integral sparging nozzles positioned thereon so as to be in opposition to the piston heads when they are secured in the apertures.
Figure 3:
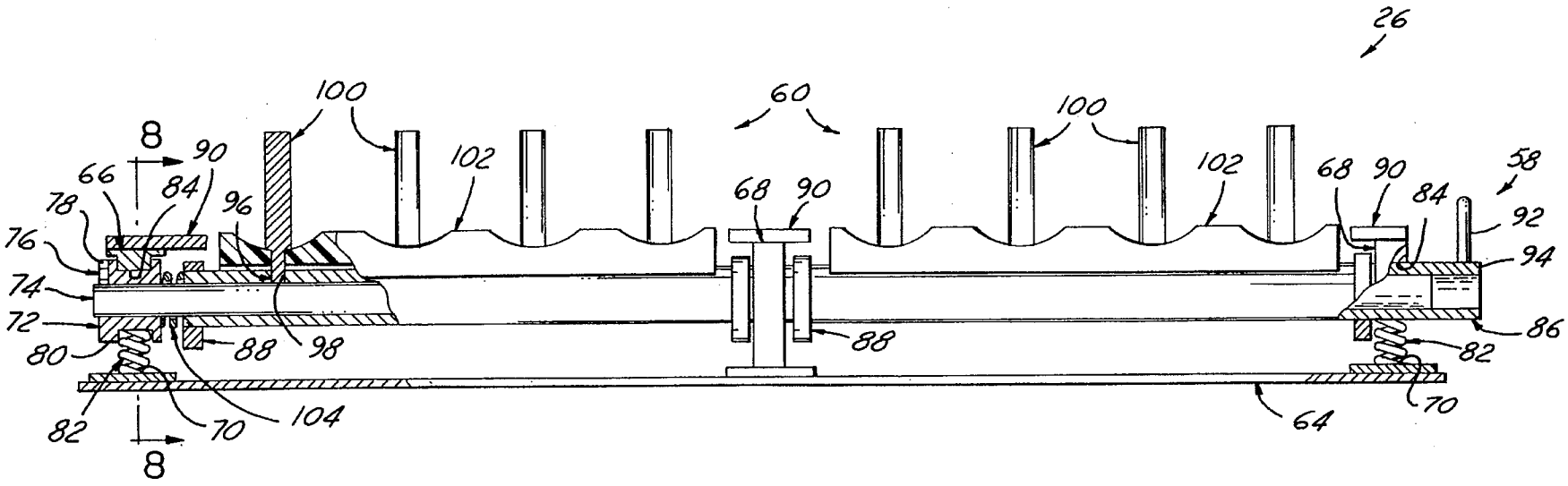
FIG. 3 is a longitudinal view, partially in cross-section, of the cammed actuator/fixture shown in FIG. 2 along line 3—3 thereof, with the fixtures translated and rotated away from the aperture to facilitate placement of the pistons thereon.

A preferred apparatus 10 for cleaning, deoxidizing, hardcoat anodizing and sealing the head of each of several aluminum pistons 12 simultaneously in accordance with the present invention is shown schematically in FIG. 1. Specifically, the apparatus 10 includes a sealed plating tank 14, a detailed view of which is shown in FIG. 2. The plating tank 14, which is preferably formed of an electrically-nonconductive and thermally-insulative material such as ABS plastic, is nominally provided with a bottom drain 16 and an overflow/vapor return 18. The plating tank 14 also has a plurality of cylindrical apertures 20 formed in its front wall 22. Each aperture 20 is adapted to receive an individual piston 12 inserted longitudinally thereinto. As will be described more fully below in connection with FIGS. 4–6, an O-ring seal 24 is disposed within each aperture 20 to effect a seal about each piston 12 when the piston 12 is inserted and subsequently secured in the aperture 20 by appropriate securing means 26 (the securing means 26 being described below in connection with FIGS. 2–8).

Returning to FIG. 1, the apparatus 10 further includes several external storage tanks 28, 30, 32, 34 containing a variety of solutions used in a preferred method for generating a hardcoat anodized surface on the head of each piston 12. For example, the first storage tank 28 is illustrated as containing an aqueous cleaning agent; the second storage tank 30, a commercial deoxidizer comprising nitric acid; the third storage tank 32, an aqueous solution of sulfuric acid ($H_2SO_4$) in a specified temperature range, e.g., at perhaps 32°±2° F. (0°±1° C.) (hereinafter "the electrolyte"); and the fourth storage tank 34, hot water maintained at over 200° F. (95° C.), to be used as a sealant. A source (not shown) of pressurized water at ambient temperature ("tap water") is also provided, as is a source of compressed hot or cold air (not shown). It is noted that the storage tanks 32, 34 for the electrolyte and the hot water are preferably insulated to reduce energy requirements and are otherwise individually heated/cooled as required.

The precise formulation of the solutions contained within the storage tanks 28, 30, 32, 34 will be known to those skilled in the plating arts. It should be appreciated, however, that the above-recited solutions are merely exemplary; other solutions suitable for use in the apparatus 10 include, without limitation, various rinsing and neutralizing solutions; caustic etches; other electrolytes; other sealing solutions, e.g., steam or sodium dichromate; solutions containing a dye to impart a desired color to the coating; and solutions containing a dry film lubricant such as "Teflon®" to make the coating "self-lubricating." The particular solutions, and the order and manner in which they are introduced into the plating tank 14, will be selected in a manner known to those skilled in the plating arts in order to achieve a particular coating on a given workpiece of specific hardness, toughness, density/porosity, wear-resistance, lubricity and/or color.

A fluid supply network, itself comprising dedicated pumps 36 and control valves 38, connects each storage tank 28, 30, 32, 34 and the source of tap water to the plating tank 14 through a supply conduit 40. One end 42 of the supply conduit 40 projects into the interior of the plating tank 14. This end 42 of the supply conduit 40 is further provided with a plurality of integral sparging nozzles 44 positioned within the plating tank 14 in opposition to the apertures 20 formed in its front wall 22. In this manner, a given solution pumped from its respective storage tank 28, 30, 32, 34 (as well as a tap water rinse) can be directed into the plating tank 14 and sparged directly onto the heads of the pistons 12 secured in the apertures 20. A network of return conduits 46 and control valves 48 connects the plating tank's drain 16 and overflow/vapor return 18 either to one of the storage tanks 28, 30, 32, 34 or to suitable waste treatment equipment (not shown).

As seen in FIG. 1, the apparatus 10 includes a rectifier 50 for supplying current to the electrolytic cell created while the pistons 12 are secured in the plating tank's apertures 20 and the electrolyte from the third storage tank 32 is directed into the plating tank 14 (whereupon the pistons 12 form the anode of the electrolytic cell). More specifically, in the preferred embodiment, the end 42 of the supply conduit 40 projecting into the plating tank 14 is preferably formed of an electrically-conductive, nonreactive material such as stainless steel so that it may be used as an electrode (cathode) during electrolysis, thereby obviating the need for a separate electrode. Accordingly, the negative terminal of the rectifier 50 is connected to that end 42 of the supply conduit 40. The positive terminal of the rectifier 50 is connected to the piston 12 when it is secured in the plating tank's aperture 20 (for clarity's sake, the positive terminal of the rectifier 50 is shown connected to but one of the pistons 12).

Referring again to the detailed view of the plating tank 14 shown in FIG. 2, electric leads 52 are shown extending within the plating tank 14 from the end 42 of the supply conduit 40 to a first set of electric terminals 54 located on one of the plating tank's exterior walls. These terminals 54 are in turn connected to the negative terminal of the rectifier 50. A second set of electric terminals 56 is provided on the actuators 26, to be connected to the positive terminal of the rectifier 50.

The means 26 for inserting and securing each piston 12 into its respective aperture 20 includes a plurality of actuators 58 mounted to the front wall 22 of the plating tank 14, and a plurality of fixtures 60 supported by the actuators 58. Each fixture 60 is adapted to receive one of the pistons 12 whose head 62 is to be hardcoat anodized in the plating tank 14. Each actuator 58 is operative both to translate and rotate the fixture 60 (and the piston 12 therein) relative to the aperture 20. The apertures 20 and their corresponding fixtures 60 are preferably arranged in rows so as to enable the use of a common actuator 58 for each row of fixtures 60 and apertures 20.

The actuators 58 and their associated fixtures 60 are shown in greater detail in FIGS. 3–8. Each of the actuators 58 includes an elongated reinforcing base plate 64 secured to the face of the plating tank's front wall 22; and at least two guide bearings 66, 68 mounted longitudinally on the base plate 64 so as to be positioned on opposite sides of at least one aperture 20. Each guide bearing 66, 68 has an elongated slot 70 extending in a direction generally parallel to the axes of the cylindrical apertures 20.

One of the guide bearings 68 for a given actuator 58 has a sleeve bearing 72 located within its slot 70. The sleeve bearing 72 is adapted to receive a first shaft 74 journalled therein (hereinafter "inner shaft 74"). A first radially-extending stop pin 76 on the inner shaft 74 engages an enlarged circumferential notch 78 formed in one longitudinal end 80 of the sleeve bearing 72 to limit the amount of relative rotation of the inner shaft 74 therein. A spring 82 located within the slot 70 biases the sleeve bearing 72 (and the inner shaft 74 it carries) away from the base plate 64 to a first end 84 of the slot 70. The inner shaft 74 is preferably formed of an electrically-conductive material such as stainless steel so that it may be connected to the positive terminal of the rectifier 50 and, hence, conduct current to the piston 12.

The other of the guide bearings 68 for that given actuator 58 are adapted to receive a second, larger-diameter shaft 86 (hereinafter "outer shaft 86") sleeved about the remaining length of the inner shaft 74. Additional springs 82 located within the slots 70 of these other guide bearings 68 similarly bias the outer shaft 86 (and the inner shaft 74 within) away from the base plate 64 to the first end 84 of their slots 70, respectively.

At least one cam 88 is carried by the outer shaft 86 proximate to each of the guide bearings 66, 68. Each cam's eccentric peripheral surface engages a complementary cam plate 90 attached to each guide bearing 66, 68 such that, upon rotation of the outer shaft 86, the cams 88 operate to displace the shafts 74, 86 within the guide bearings 66, 68 away from their first ends 84 and towards the front wall 22 of the plating tank 14. In this regard, it is noted that the outer shaft 86 is illustrated as being manually rotated by means of a lever 92 extending radially from the outer shaft 86 at its free end 94. It should be appreciated, however, that the inner shaft 74 may be driven by any device suitable for imparting controlled rotary motion to a shaft, such as a stepper motor (not shown), thereby facilitating system automation.

A second radially-extending stop pin 96 on the inner shaft 74 extends through an enlarged circumferential slot 98 formed in the outer shaft 86. The outer shaft 86 is thus free to rotate about the inner shaft 74 within a prescribed range, after which the second stop pin 96 engages one or the other of the slot's circumferential ends to prevent further rotation of the outer shaft 86 relative to the inner shaft 74. In this manner, the inner shaft 74 is selectively driven by the outer shaft 86.

As seen in FIGS. 3–6, the inner shaft 74 of each of the actuators 58 supports a plurality of fixtures 60, each adapted to receive a piston 12 whose head 62 is to be coated using the apparatus 10. Each fixture 60 includes a post 100 which extends radially-outwardly from the inner shaft 74 through a complementary aperture formed in the outer shaft 86. For simplicity and redundancy, in the preferred embodiment, the posts 100 themselves comprise radial extensions of several "second stop pins 96." Each post 100, like the inner shaft 74, is preferably formed of an electrically-conductive material so that it may be used to complete the electrical circuit between the rectifier 50 and the piston 12. In the preferred embodiment shown in FIG. 2, the fixture 60 also includes a cradle 102 mounted on the post 100 near its base. The cradle 102, which is preferably formed of a nonreactive polyurethane such as that sold under the trademark "Delrin®" for supporting the piston 12 so as to prevent its rotation about the post 100.

In the preferred embodiment, an axial detent is formed in each circumferential end of the outer shaft's circumferential slot 98. A helical spring 104 is located about the inner shaft 74 between the sleeve bearing 72 and the outer shaft 86 to axially bias the outer shaft 86 relative to the inner shaft 74 and, in turn, bias the second stop pin 96 into the detents. As a result, as long as the second stop pin 96 engages one of the detents, the outer shaft 86 will continue to drive the inner shaft 74, notwithstanding the fact that the second stop pin 96 may be at the "wrong" end of the slot 98. Of course, the second stop pin 96 will engage the detent in this manner only until such time as sufficient resistance to further rotation of the inner shaft 74 is encountered, as where the first stop pin 76 on the inner shaft 74 engages an end of the sleeve bearing's circumferential notch 78.

Figure 4:
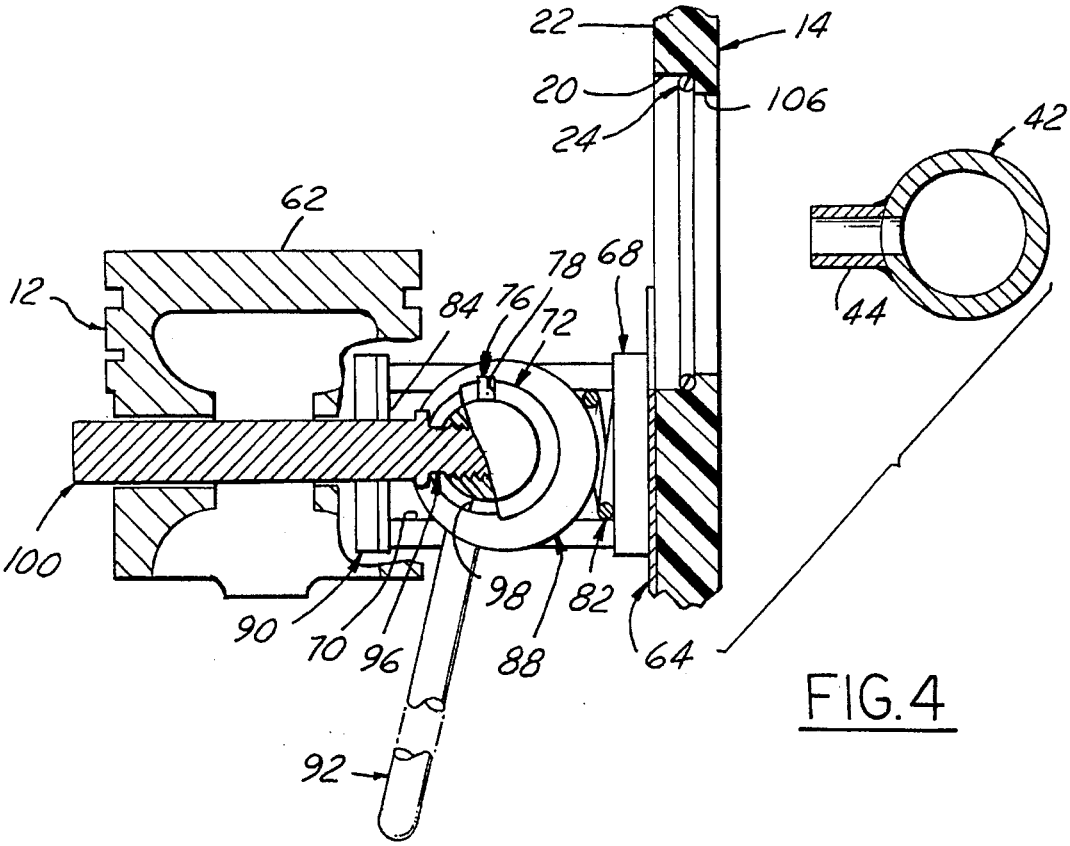
FIG. 4 is a first view in cross-section of the plating tank aperture, cammed actuator/fixture and opposed sparging nozzle of FIG. 2 along line 4—4 thereof, with the piston translated and rotated away from the aperture to facilitate its placement on the fixture, and further with the sleeve bearing/stop pin arrangement on the near end of the actuator superimposed, but without the fixture's supporting cradle.
Figure 5:
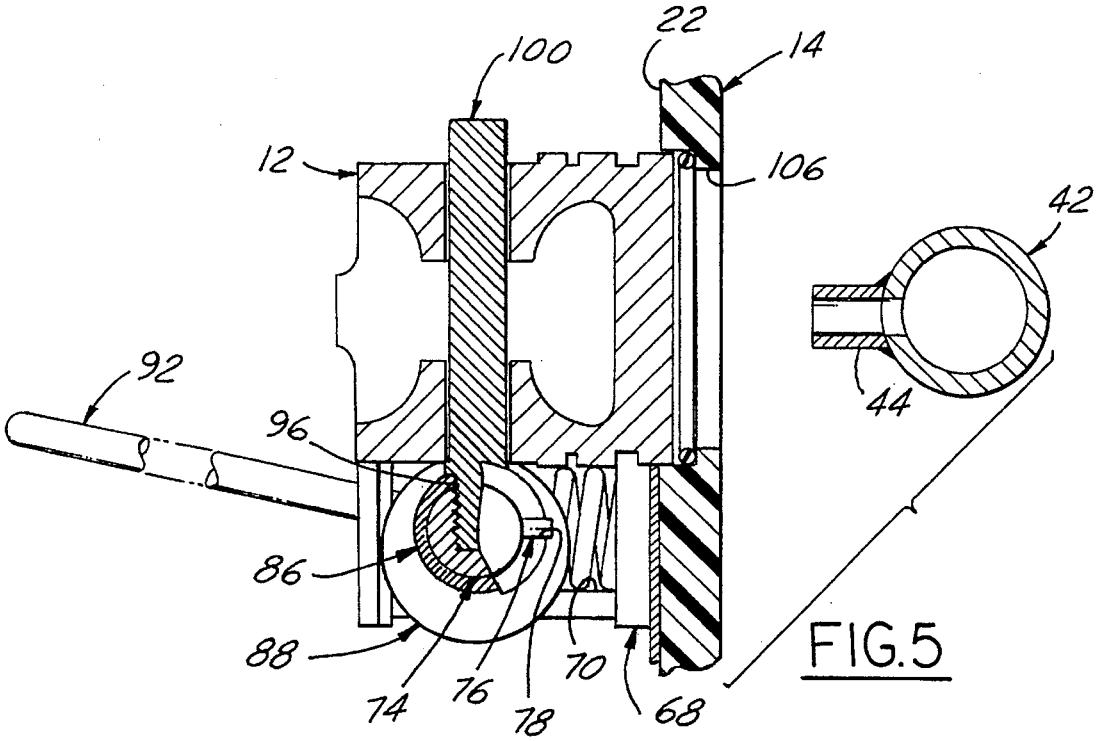
FIG. 5 is a second view in cross-section of the plating tank aperture, cammed actuator/fixture and opposed sparging nozzle of FIG. 2 similar to that of FIG. 4, but with the piston rotated into alignment with the aperture and further translated so as to be partially inserted into the aperture.
Figure 6:
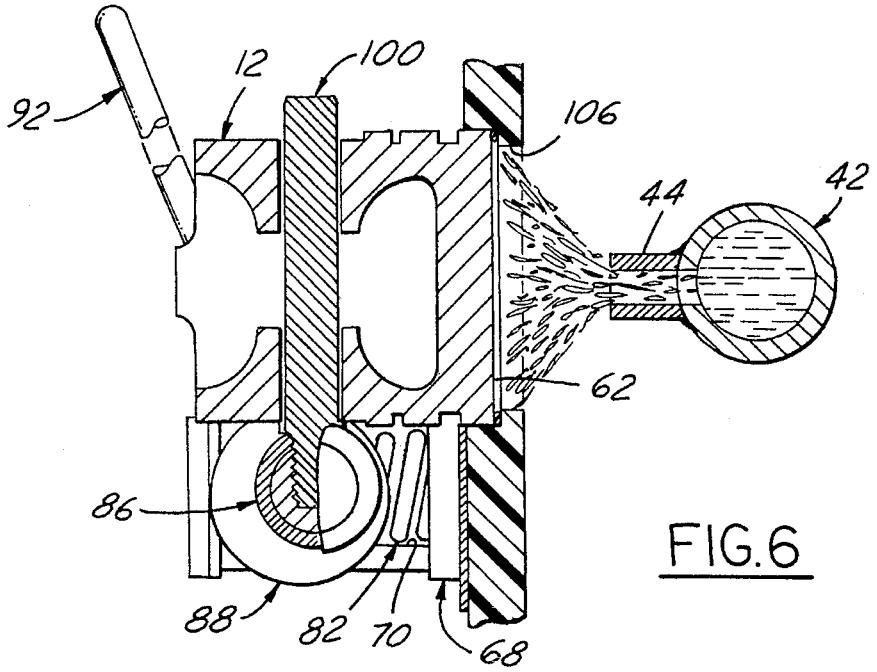
FIG. 6 is a third view in cross-section of the plating tank aperture, cammed actuator/fixture and opposed sparging nozzle of FIG. 2 similar to that of FIG. 4, but with the piston rotated into alignment with the aperture and further translated so as to be fully inserted into the aperture, thereby axially compressing the O-ring seated within the aperture to seal the aperture.
Figure 7:
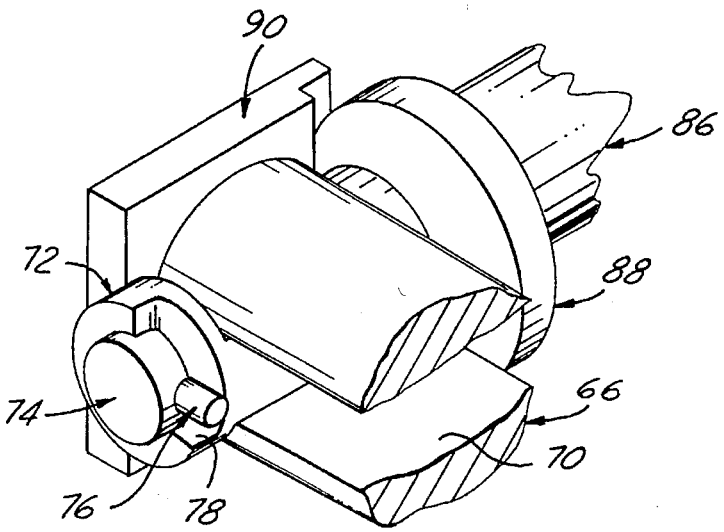
FIG. 7 is a detail view in perspective of the guide bearing/cam plate, sleeve bearing, inner shaft, outer shaft, stop pin and cam comprising the near end of a cammed actuator as seen in FIG. 2.
Figure 8:
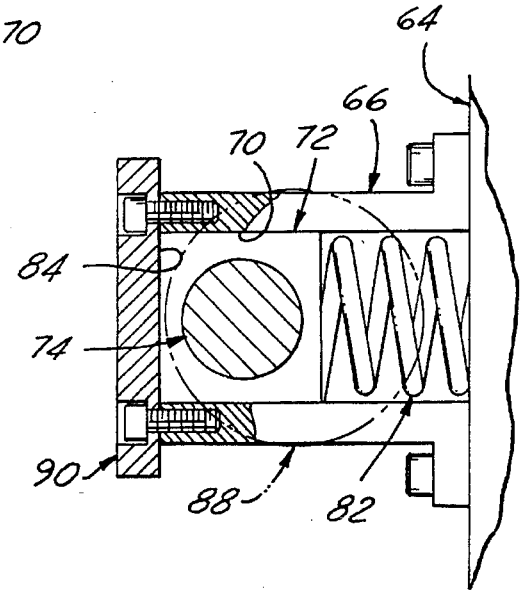
FIG. 8 is a second detail view in partial cross-section of the guide bearing/cam plate, cam and biasing spring comprising the near end of a cammed actuator shown in FIG. 2 and, particularly, along line 8—8 of FIG. 3.

Upon encountering such resistance, the second stop pin 96 will pop out of the detent, and any further rotation of the outer shaft 86 will rotate only the outer shaft 86. The outer shaft 86 (and the inner shaft 74 therein) will thus be cammed towards the front wall 22 of the plating tank 14. The first stop pin 76 simultaneously cooperates with the sleeve bearing's circumferential notch 78 to maintain the orientation of the inner shaft 74 and guide the piston 12 into its respective aperture 20. Upon full insertion of the piston 12 into the aperture 20, the second stop pin 96 will engage the detent at the other end of the outer shaft's circumferential slot 98, thereby securing the piston 12 within the aperture 20. FIGS. 4–6 illustrate the various positions of the outer shaft 86, the inner shaft 74/first stop pin 76, and the sleeve bearing's circumferential notch 78.

From the foregoing, it will be appreciated that rotation of the outer shaft 86 initially produces pure rotation of the fixture 60 until such time as the first stop pin 76 engages the other end of the sleeve bearing's circumferential notch 78. And, once the first stop pin 76 has so engaged the end of the sleeve bearing's circumferential notch 78, any further rotation of the outer shaft 86 will produce pure translation of the fixture 60 towards the tank's front wall 22 so as to effect insertion of the piston 12 into the aperture 20.

To remove the piston 12 from the aperture 20 after generating the desired coating, the above-described insertion/securing steps are reversed. Specifically, the operator will rotate the outer shaft 86 in the opposite direction (downward as shown in FIGS. 4–6), whereupon initial rotation of the fixture 60/inner shaft 74 will be inhibited by contact between the piston 12 and the aperture 20. As a result, the second stop pin 96 will pop from its detent in the end of the outer shaft's circumferential slot 98. The outer shaft 86 will therefore rotate freely of the inner shaft 74 until the second stop pin 96 engages the opposite end of the outer shaft's circumferential slot 98.

Meanwhile, rotation of the outer shaft 86 imparts rotation to the cams 88, whereupon the cams 88 exert a reduced force on the shafts 74, 86 and the springs 82 operate to translate the shafts 74, 86 back towards the first ends 84 of the guide bearings 66, 68. Once the shafts 74, 86 have been fully translated back to the first ends 84 of the guide bearings 66, 68 and the second stop pin 96 has engaged the other end of the outer shaft's circumferential slot 98, any further rotation of the outer shaft 86 will also rotate the inner shaft 74/fixture 60. The fixture 60 may thus be rotated away from the plating tank 14 to facilitate removal of the thus-coated piston 12 from the present apparatus 10.

Referring once again to FIGS. 4–6, in the preferred embodiment, the O-ring seal 24 used to seal each aperture 20 about the piston 12 the O-ring 24 is itself located within the aperture 20 as against an internal flange 106. Upon inserting and axially advancing the piston 12 into the aperture 20 with the actuator 58, the O-ring 24 is axially compressed between the periphery of the piston's head 62 and the aperture's internal flange 106, thereby achieving a fluid-tight seal between the piston 12 and the aperture 20. Accordingly, the piston's head 62, and only its head 62, is placed in fluid communication with the interior of the plating tank 14, while the aperture 20 is otherwise sealed or "plugged" with the piston 12 itself. The O-ring seal 24 thus performs the dual functions of sealing the aperture 20 about the piston 12 while effectively "masking" the workpiece so as to permit the electrolytic coating of but a portion of its exposed surface.

Finally, a brief discussion of the operation of the apparatus 10 once the pistons 12 have been secured in their respective apertures 20 in the plating tank 12: with the apertures 20 now "plugged" with the pistons 12, the plating tank 14 is ready to receive different processing solutions from the storage tanks 28, 30, 32, 34, as well as intermediate and final tap water rinses. The solutions are selectively and sequentially directed by their dedicated pumps 36 from their respective storage tanks 28, 30, 32, 34 into the supply conduit 40. The supply conduit 40 in turn feeds the sparging nozzles 44 positioned within the plating tank 14 in opposition to the heads 62 of the pistons 12, whereby the solutions are sparged onto the heads 62 of the pistons 12. After each solution is drained from the plating tank 14, compressed air may be directed through the plating tank 14 and the supply and return conduits 40, 46 to increase recovery thereof (and to correlatively normalize the temperature of the workpiece to prevent deleterious condensation upon removal of the workpiece from the plating tank 14). Depending upon the particular processing solution, the plating tank 14 may preferably also be rinsed with tap water prior to the directing thereinto of another solution or the removal of the workpieces from the plating tank 14.

When the sparged solution is the electrolyte, the rectifier 50 is operated to apply current across the electrolyte, with the piston 12 as anode and the sparging nozzles 44 as cathode. Meanwhile, heat and gas byproducts generated during electrolysis are transported from the plating tank 14 and, preferably, back to the electrolyte's storage tank 32 through the overflow/vapor return conduit 46. The transporting of the heat and gas byproducts from the interior of the plating tank 14 ensures superior coating quality and consistency. Moreover, the hydrogen gas generated during electrolysis and vented from the plating tank 14 can either be recovered at the electrolyte storage tank 32 or otherwise vented to atmosphere at a location remote from the plating tank 14, thereby further promoting worker safety.

Since the temperature of the piston 12 will likely have been raised above ambient when the coated surface is sealed with hot water, there is little likelihood of condensation forming on the coated surface upon removal of the piston 12 from the plating tank 14. However, if the sealing step is eliminated (making the last solution a neutralizing rinse with tap water at room temperature), a greater likelihood exists that the temperature of the coated surface will be below ambient upon removal of the piston 12 from the plating tank 14, given the relatively-low temperature of the electrolyte. Therefore, in accordance with another feature of the invention, heated air is circulated through the plating tank 14 to normalize the temperature of the coated surface and, hence, prevent such later condensation of ambient moisture thereon upon removal of the pistons 12 from their respective apertures 20.

While the preferred embodiment of the invention has been disclosed, it should be appreciated that the invention is susceptible of modification without departing from the spirit of the invention or the scope of the subjoined claims. For example, while the invention has been described above in connection with the hardcoat anodizing of an aluminum piston, it should be appreciated that the apparatus 10 of the present invention is suitable for the electro-chemical treatment of a variety of other metals, including titanium and magnesium; and with a broad range of acid electrolytes/electrolyte temperatures.

We claim:

1. An apparatus for simultaneously generating an electrolytic coating on a first surface portion of each of at least two electrically-conductive workpieces, said apparatus comprising:

a plating tank having an interior and including a wall having at least two apertures formed therein adapted to receive said workpieces, one of said workpieces to one of said apertures, said tank further including at least one electrode extending into the plating tank, and a drain;

means for temporarily securing said workpieces in said apertures so as to place the first surface portions thereof in fluid communication with the interior of said tank;

a seal for sealing said apertures about said workpieces when said workpieces are secured therein such that only the first surface portion of said workpieces are placed in fluid communication with the interior of the plating tank;

means for directing an electrolyte into said tank such that said electrolyte bridges each of said workpieces and said at least one electrode; and a power supply connected to said workpieces and said at least one electrode, respectively, for applying a current across said electrolyte in said tank when said electrolyte bridges said workpieces and said at least one electrode, whereby an electrolytic coating is generated on the first surface portion of each of said workpieces; and means for directing a rinsing fluid into the tank to rinse the first surface portion of each of said workpieces.

2. A method for simultaneously generating a coating on a first surface portion of each of at least two electrically-conductive workpieces, said method including the steps of:

securing said workpieces in at least two apertures extending through a wall of a plating tank, said plate tank having an interior, one of said workpieces to one of apertures, wherein the apertures are adapted to sealingly engage said workpieces upon the securing of said workpieces therein such that only the first surface portion of each of said workpieces is placed in fluid communication with the interior of said plating tank;

directing an electrolyte into said plating tank, said electrolyte bridging an electrode in said plating tank and the first surface portion of each of said workpieces;

applying a current through said electrolyte as said electrolyte bridges said workpieces and said electrode, with said workpieces as anode and said electrode as cathode;

draining said electrolyte from said plating tank;

directing a rinsing fluid into said plating tank;

draining said rinsing fluid from said plating tank; and removing said workpieces from said apertures.

3. The method of claim 2, wherein said method further includes the step of sparging said electrolyte during said first directing step.

4. The method of claim 2, wherein said first directing step includes the step of circulating said electrolyte between said plating tank and an external storage tank in fluid communication with said plating tank during said current application step.

5. The method of claim 2, wherein said method includes, after said securing step and prior to said first directing step, the steps of:

directing into said plating tank a pre-electrolyte treating fluid from the group consisting of a cleaning solution, a deoxidizing solution, a caustic etch, an activating solution, and water; and draining said pre-electrolyte treating fluid from said plating tank.

6. The method of claim 2, wherein said method further includes, after said second draining step and prior to said removing step, the steps of:

directing into said plating tank a post-electrolyte treating fluid of the group consisting of a sealing solution, a solution containing a dye, and a solution containing a dry lubricant;

maintaining said post-electrolyte treating fluid in contact with the first surface portions of said workpieces for a predetermined time period; and draining said post-electrolyte treating fluid from said plating tank.

7. The method of claim 2, wherein said method further includes the step of directing heated air into said plating tank after said second draining step and prior to said removing step.

8. The method of claim 2, wherein said electrolyte in said plating tank is below room temperature, said method further including the step of heating said workpieces to room temperature prior to said removing step.

9. The method of claim 2, wherein said plating tank is sealed, and wherein said method further includes the step of venting said plating tank to a location remote from said plating tank.

10. The apparatus of claim 1, wherein said means for temporarily securing said workpieces in said apertures includes at least one fixture adapted to receive at least one of said workpieces; and an actuator mounted on said plating tank for supporting said fixture relative to at least one of said apertures, said actuator being operative to translate said fixture relative to said at least one of said apertures, whereby said at least one of said workpieces is inserted into and removed from said at least one of said apertures.

11. The apparatus of claim 10, wherein each of said workpieces is a piston; and wherein said fixture includes a post adapted to receive one of said pistons, and a cradle for supporting said one of said pistons to prevent rotation thereof about said post.

12. The apparatus of claim 10, wherein said actuator is further operative to rotate said fixture relative to said at least one of said apertures, whereby placement of said at least one of said workpieces into said fixture is facilitated.

13. The apparatus of claim 10, wherein said actuator includes:

a pair of slotted bearings mounted on said plating tank;

a first shaft received in said slotted bearings, said first shaft being movable within said slotted bearings between a first position relative to said plating tank and a second position relative to said plating tank and a second position therein;

a spring on each of said bearings for biasing said first to the first position therein;

a cam plate mounted on each of said slotted bearings;

a pair of cams carried by said first shaft, each cam being engageable with one of said cam plates, respectively, to displace said first shaft from the first position to the second position upon rotation of said first shaft;

and wherein said fixture is supported by said first shaft.

14. The apparatus of claim 13, wherein said first shaft is hollow; and wherein said actuator includes a second shaft journaled within said first shaft, said fixture being attached to said second shaft.

15. The apparatus of claim 14, wherein said second shaft is driven by said first shaft; and including stop means on said second shaft for limiting the rotation of said second shaft relative to said bearings, whereby rotation of said first shaft relative to said bearings produces either pure rotation of said fixture relative to said bearings when said first shaft is in the first position, or translation of said fixture as said bearings are moved from the first position in said bearings to the second position therein.

16. The apparatus of claim 1, wherein said means for directing said electrolyte into said plating tank includes a sparger nozzle positioned within said plating tank in opposition to the first surface portions of said workpieces when said workpieces are secured in said apertures.

17. The apparatus of claim 1, wherein said means for directing said electrolyte into said plating tank includes a storage tank for storing a supply of said electrolyte, a supply conduit extending from said storage tank to said plating tank, a pump operative to pump electrolyte stored in said storage tank through said supply conduit into said plating tank, and a first return conduit extending from the drain of said plating tank to said storage tank.

18. The apparatus of claim 12, wherein said plating tank is sealed; and including a second return conduit extending from said plating tank to said storage tank, said second return conduit being connected to said plating tank at a point thereon above the normal operating level of said electrolyte therein.

19. The apparatus of claim 17, including means on said storage tank for maintaining said electrolyte at a desired temperature.

* * * * *